United States Patent [19]

McGuire

[11] 4,315,423

[45] Feb. 16, 1982

[54] TUBE BENDING MANDREL

[75] Inventor: Samuel B. McGuire, Arvada, Colo.

[73] Assignee: Bending Products, Inc., Englewood, Colo.

[21] Appl. No.: 154,923

[22] Filed: May 30, 1980

[51] Int. Cl.[3] ..... B21D 9/03

[52] U.S. Cl. ..... 72/466; 72/478

[58] Field of Search ..... 72/150, 466, 478, 479

[56] References Cited

U.S. PATENT DOCUMENTS

| | | | |
|---|---|---|---|
| 3,286,503 | 11/1966 | Garrett | 72/466 |
| 3,408,850 | 11/1968 | Maier et al. | 72/466 |
| 3,750,455 | 8/1973 | Stange et al. | 72/466 |
| 4,123,930 | 11/1978 | Hill et al. | 72/466 |

*Primary Examiner*—Lowell A. Larson

*Attorney, Agent, or Firm*—Edwin L. Spangler, Jr.

[57] ABSTRACT

This invention relates to an improved tube bending mandrel of the general type having fixed and bendable sections and wherein the latter comprises a chain of ball and socket elements linked together in end to end relation with each such element being encircled by a ring of the same diameter as the fixed section cooperating therewith and with one another to define limited movable universal connections therebetween. More specifically, the instant invention relates to an improved ball and socket assembly wherein the ball portion comprises two or more spherically-surfaced ring segments which cooperate with each other and with a spherically-concave head formed integral with the body in which the socket is formed on the opposite end of the link to form the ball. The improved mandrel also encompasses dimensioning the socket in the head in relation to the neck of the adjacent socket around which the ball-forming segments are disposed such that the latter can neither be removed nor inserted until the ring surrounding same has been removed and the assembled ring and socket thereabove are tilted to one side and seated within a suitably placed recess. The improved mandrel further includes an expandable ring detent surrounding the ball that temporarily seats with an annular groove in the socket to releasably maintain the elements of the bendable section in axial alignment with one another and with the fixed section.

10 Claims, 6 Drawing Figures

TUBE BENDING MANDREL

Tube bending mandrels are well known in the art and their purpose is to support the inside of a tube while it is being drawn or otherwise bent around a suitable forming die. Mandrels of the general type referred to above form the subject matter of prior art U.S. Pat. Nos. 3,190,106 and 3,455,142. Common to all such mandrels along with that forming the subject matter of the instant invention is a fixed section and a bendable section on one end of the fixed section. The bendable section is made up of a series of link-forming elements connected together in end to end relation for universal movement by means of a ball and socket connection therebetween. Surrounding each mated ball and socket is a ring, the outside diameter of which matches that of the fixed section. The rings nest inside one another when tilted and thus cooperate to limit the extent of relative universal movement.

The primary differences between these various mandrel designs lies in the way in which the ball and socket connection is formed and maintained. In Spates U.S. Pat. No. 3,190,106, for example, he makes the ball and socket element in two halves split longitudinally and then uses the ring to hold the two halves together. The so-called "Roberts Mandrel" forming the subject matter of U.S. Pat. No. 3,455,142, on the other hand, uses a one-piece ball and essentially a two-piece socket in the sense that a retaining member inside the ring completes the socket and holds the ball in place therein. Both of the above patented mandrels use spring-biased ball detents inside the ball that enter dimples in the socket to releasably hold the links of the bendable section in axial alignment.

It has now been found in accordance with the teaching of the instant invention that a significantly improved and simplified link-forming subassembly can be made by the simple, yet unobvious, expedient of forming a portion of the ball integral with the socket on the end of a neck extending axially therefrom and then completing the ball with two or more, and preferably three ring-forming spherically-surfaced segments of 120° in angular extent that wrap around the neck in encircling relation thereto. Before these segments can be inserted or removed, however, the ring encircling the body in which the socket is formed must first be removed to free the link assembly adjacent thereto for tiltable movement into a position where a sufficient gap is created at the mouth of the aforementioned socket to pass the ring segments. The rim of the body containing the socket defines an annular stop normally preventing the adjacent link assembly from tilting to this degree even with the ring surrounding same removed; however, a recess is provided on the rim adapted to receive a portion of the adjacent link assembly in a selected position so that it can, in fact, tilt to the required degree. A specially placed recess is located in the mouth of each socket to receive the base of the link adjacent thereto so that when the latter is tilted to one side, a sufficient gap is created diametrically opposite the recess to get the segments in and out. In addition, an annular as opposed to an axial spring detent arrangement releasably holds the links of the bendable subassembly in axial alignment to facilitate loading them into the tubular workpiece.

It is, therefore, the principal object of the present invention to provide a novel and improved tube bending mandrel.

A second objective is the provision of a unit of the class described that is more easily assembled and disassembled than the prior art units of similar design.

Another object of the invention herein disclosed and claimed is to provide a mandrel that is extremely rugged and easily capable of withstanding the severe stresses to which such units are subjected in normal use.

Still another objective is the provision of a tube bending mandrel that can be lengthened or shortened easily and without special tools.

An additional object is to provide a mandrel of the type forming the subject matter hereof that is suitable for use in a wide variety of tube and pipe bending applications with but minor variations, if any, in such easily controllable parameters as length, surface, material, hardness, etc.

Other objects will be in part apparent and in part pointed out specifically hereinafter in connection with the description of the drawings that follows, and in which.

Figure 1:
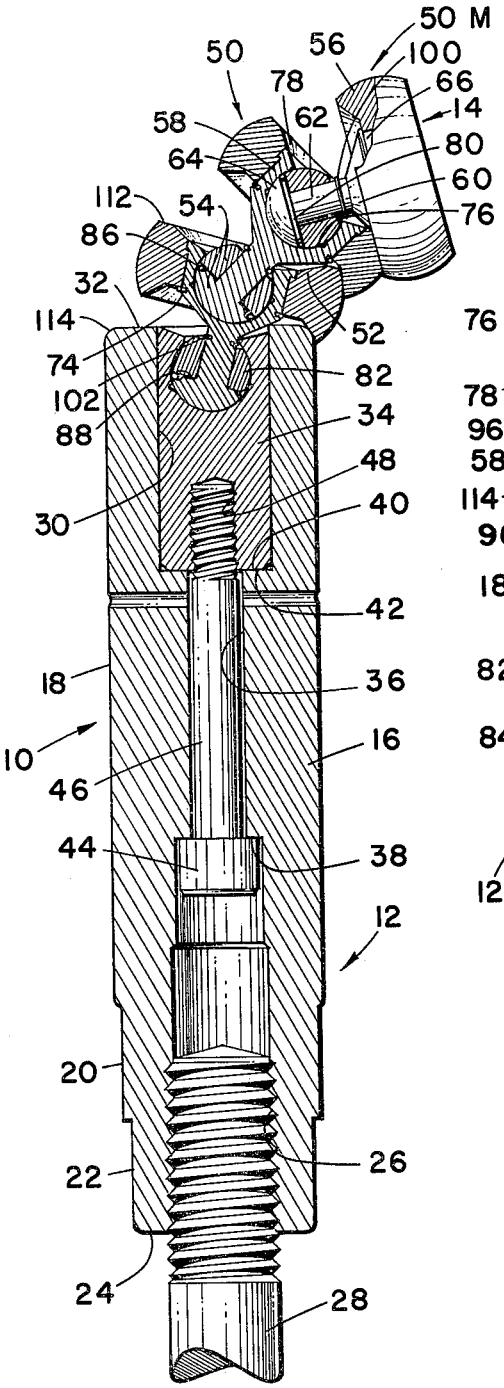
FIG. 1 is a view partly in elevation and partly in diametrical section showing the complete mandrel.
Figure 3:
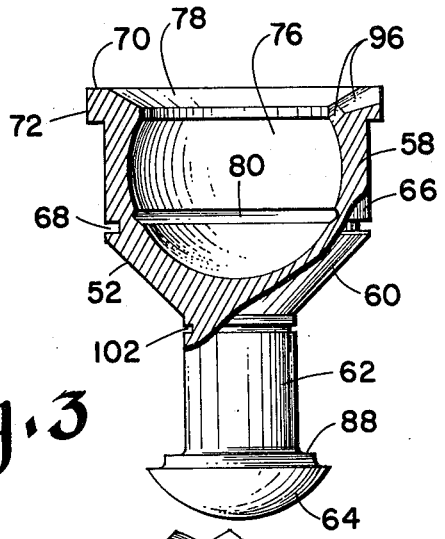
FIG. 3 is an elevational view of the link element that includes a portion of the ball formed integrally with the socket, such having been drawn to a still further enlarged scale and with portions broken away and shown in diametrical section.
Figure 4:
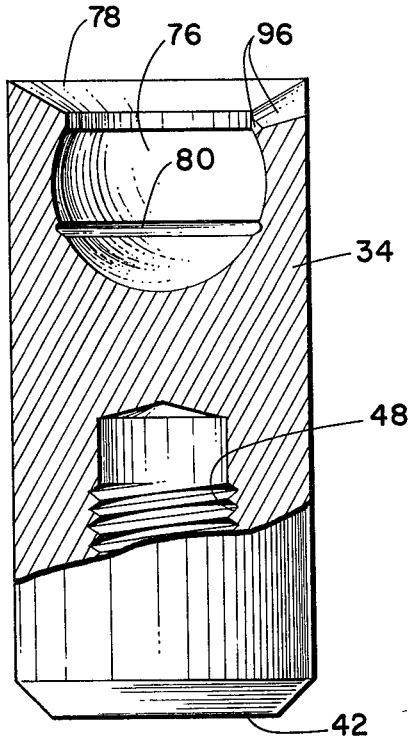
FIG. 4 is an elevational view of the plug to the same scale as FIG. 3.
Figure 6:
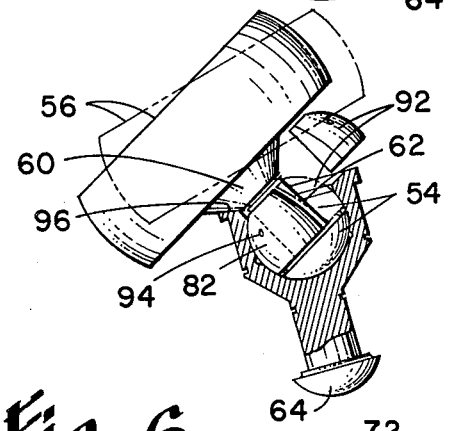
Figure 5:
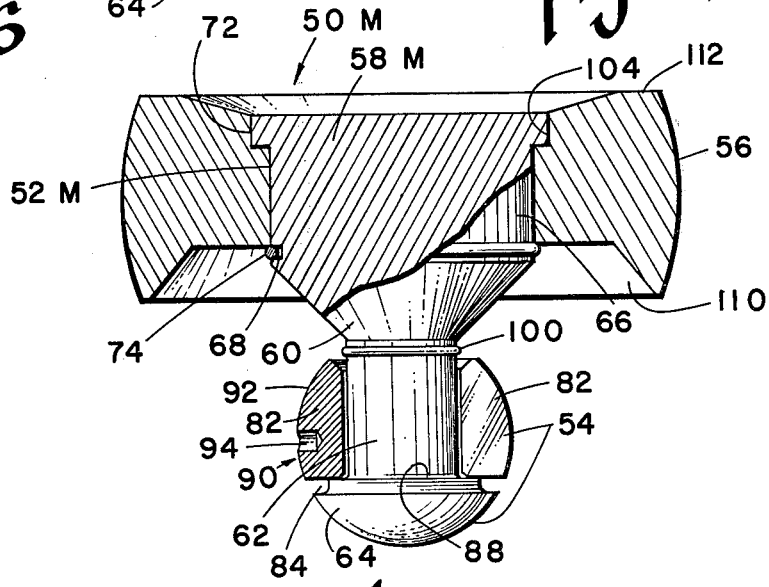

FIG. 5 is an elevational view of the link subassembly that includes the link member, segmented ball and ring therearound, all to the same scale as FIGS. 3 and 4 and with portions broken away and shown in diametrical section; and, FIG. 6 is an elevational view partly in diametrical section to a scale somewhat larger than FIG. 1 but smaller than inclusive, showing the manner in which the mandrel is assembled.

Figure 2:
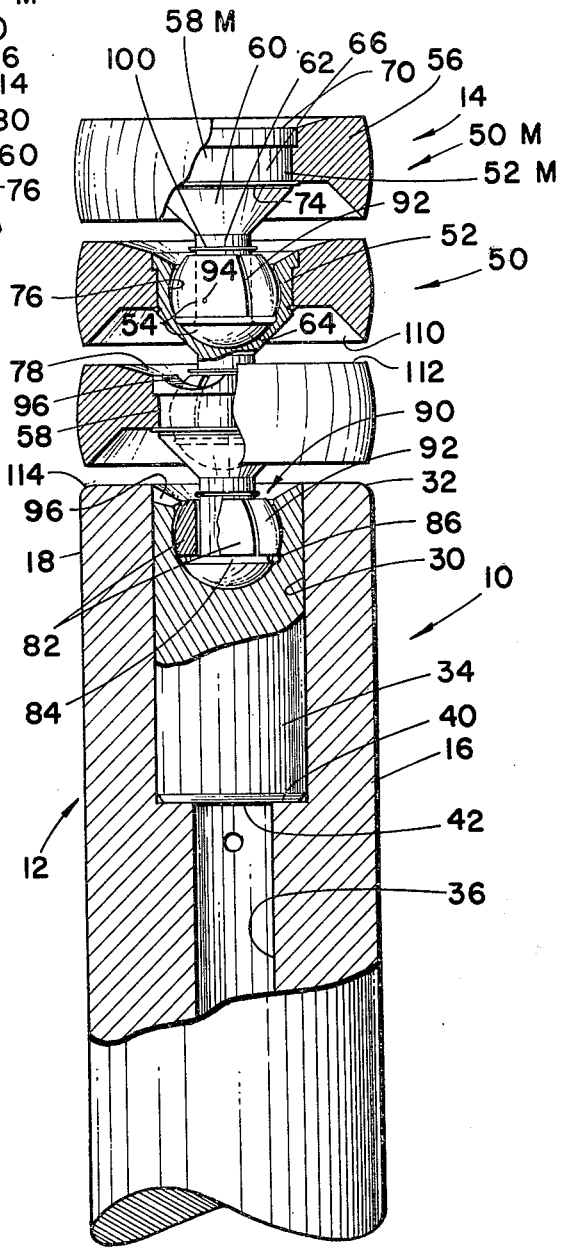
FIG. 2 is a fragmentary view to an enlarged scale showing the mandrel partly in elevation and partly in diametrical section with the bendable section thereof in axially-aligned condition.

Referring next to the drawings for a detailed description of the present invention and, initially to FIGS. 1 and 2 for this purpose, reference numeral 10 has been selected to broadly designate the tube bending mandrel in its entirety while numerals 12 and 14 have been similarly employed to connote the straight or rigid and the bendable or flexible sections thereof, respectively. The straight section 12 is in the form of a stepped cylinder 16 having a main section 18 adjacent the bendable section 14 and a pair of successively smaller sections of reduced diameter 20 and 22 on the end 24 thereof remote from the aforesaid bendable section.

End 24 has an internally-threaded axial opening 26 therein for the reception of threaded stem member 28. A smooth-surfaced counterbore 30 extends axially in from the opposite end 32 to receive a plug 34. Connecting opening 26 with counterbore 30 is an axial bore 36 of reduced diameter that cooperates with the latter to define oppositely-facing annular shoulders 38 and 40. The bottom or inner end 42 of plug 34 rests atop shoulder 40 while the head 44 of cap screw 46 does likewise on shoulder 38. Cap screw 46 screws into threaded socket 48 in inner end 42 of plug 34 thus detachably fastening the latter within counterbore 30.

Up to this point the mandrel of the instant invention differs in only minor details from the prior art mandrels since all of them show these same elements of the rigid section 12 even though the way they are held in assembled relation may vary slightly from one to another. It is, therefore, the bendable section 14 wherein the principal novelty lies. An understanding of the latter can best be had by first examining the link assemblies individually which have been broadly designated by reference numeral 50. These individual link assemblies are most clearly revealed in FIGS. 3, 4 and 5 to which detailed reference will next be made before referencing FIG. 6 to learn how they are assembled and coact in this condition.

Each individual link assembly consists of three principal parts, namely: a link member 52; a ball subassembly 54, a portion of which is formed integral with the link member; and a ring member 56 together with certain retaining rings that will be pointed out presently. Link member 52 is cast or otherwise formed in one piece to provide a body 58 merging at its steeply-tapered base 60 into a neck 62 topped by a spherically convex head 64. Body 58 usually, but not necessarily, has a cylindrical outer surface 66 encircled intermediate its ends by an annular retaining ring groove 68 located at approximately the juncture between the latter and its tapered base 60. The end 70 of the body remote from neck 62 is encircled by an annular stop-forming rib 72 which cooperates with retaining ring 74 when seated in annular groove 68 to hold ring member 56 in place upon link member 52.

The interior of body 58 is hollowed out to define a truncated spherical socket 76 opening onto rim 70 through a flared throat 78. Spherical socket 76 is well in excess of 180° in angular extent but less than 270°, somewhere between around 240°± a few degrees being preferred. The entrance thereto through throat 78 is, therefore, substantially less than the diameter of the socket.

The radius of curvature of socket 76 is the same as that of head 64 which seats in the bottom thereof as shown in FIGS. 1 and 2. Also, in the preferred embodiment illustrated, a shallow groove 80 encircles the socket in a plane normal to the axis of neck 62 and spaced above the bottom thereof a distance corresponding to the depth of head 64. When the segments 82 of ball subassembly 54 are assembled on neck 62 in the manner most clearly revealed in FIG. 5, they cooperate with head 64 to define an annular groove 84 which is coplanar with groove in the socket when the ball subassemblies and sockets in the link members are connected together in axial alignment in the manner shown in FIG. 2. With a springable ring 86 seated in groove 84 as shown in FIG. 2, such a ring will expand out into groove 80 and maintain the axially-aligned condition of the flexible and rigid sections of the mandrel while the latter is inserted into the tubular workpiece (not shown) which is to be bent. Once the flexible section moves around a curve in the workpiece, rings 86, of course, contract to the extent required to come out of grooves 80 thus freeing the flexible section to bend.

In FIG. 5 it can be seen that an annular ledge 88 separates neck 62 from head 64 and defines a supporting surface for the segments 82 to rest upon while they define groove 84 and, more significantly, cooperate with one another and with the aforementioned head to produce the ball that has been indicated in a general way by reference numeral 90 and which fits within socket 76 to define a ball and socket connection with limited universal movement. Each ball-forming segment 82 in the particular form shown is 120° in angular extent with a spherical outer surface 92 and a cylindrical inner surface radiused to loosely fit neck 62 as indicated. One or more segments 82M of the three may, if desired, be provided with an indentation 94 of some sort adapted to receive a pointed tool (not shown) that is used to disassemble the ball. Such an indentation must, of course, be accessible from outside socket 76 when the tapered base 60 is laid over to one side and into the conically-concave recess 96 provided therefor in the rim that defines the flared throat 78 of the body, the purpose of which will be set forth in greater detail presently.

Once the balls 90 are complete inside socket 76 as shown in FIGS. 1 and 2, a retaining ring 100 (FIG. 5) seated in an annular groove 102 encircling the neck 62 adjacent base 60 effectively maintains the ball assembly 54 in assembled relation although, as will be shown presently, with all the elements of the mandrel fully assembled, there is virtually no chance of the segments 82 getting out of the socket unless the assembly has become worn to the point where sufficient elongation of the bendable section has occurred to permit a segment to escape. In other words, it is only when the tapered base 60 is laid over into conically-concave recesses 96 in the surface of the throat that the gap between the neck 62 and the opening into socket 76 becomes wide enough to remove the ball segments 82 and this can only take place under normal circumstances when the ring member 56 surrounding the latter has been removed. Before going into this feature of the invention in detail, however, it would be well to point out some modifications in certain elements of the flexible section 14 for which purpose brief reference will be made to FIGS. 1, 2, 4 and 5.

The end link assembly 50M differs from the two intermediate ones in that body 58M of terminal or end link member 52M actually has no socket since none is required at this point. The element on the other end of the chain that houses socket 76 is actually plug 34. In a similar manner the ring 56 of the flexible portion 14 becomes the stepped cylinder 16 of fixed section 12.

Turning attention to FIG. 6, the sequence followed in assembling the mandrel will now be described. Starting with end link assembly 50M, the ring 56 is passed over the head and neck of modified end link member 52M until annular stop-forming rib 72 bordering body 58M seats in annular groove 104 provided in the face thereof. Snap ring 74 is then expanded and seated in groove 68 to keep the ring in fixed position on cylindrical surface 66 of the body. Before mounting ring 56 on the adjacent link member 52, link 52M can still be tilted into the extreme full line position wherein the base 60 thereof lies recessed within recess 96 in the rim and throat of link 52. Moreover, it is only with such ring removed that such an extreme tilt becomes possible.

Next, the spherical head 64 of end link member 52M is seated in the socket 76 within the adjacent hollowed-out link members 52 along with spring ring 86. At this point, there is only one position that the assembly consisting of link member 52M, its ring 56, retaining ring 74 and spring ring 86 can occupy relative to socket 76 that will permit the insertion of the ball segments 82 and that is the position shown in full lines wherein tapered base 60 of member 52M is tilted over into recesses 96 provided in the rim 70 and flared mouth 78 of its hollowed-out counterpart 52. With the elements thus positioned, the segments 82 can be inserted one at a time through the gap in the throat of link element 52 that lies diametrically opposite the aforementioned recess. As each segment in turn is inserted, it is pushed around the neck so as to leave room for the next one until all three are in place completing the ring thereof. These segments as they seat atop ledge 88 adjacent the head 64 will also complete groove 84 while, at the same time, retaining spring ring 86 therein. The final step in the assembly of link 50M is to expand and slip lock ring 100 into groove 102 although, as previously noted, such a retaining ring is superfluous under all but conditions of extreme wear.

Ring 56 is then slipped onto the cylindrical surface 66 of socket member 52 and locked in place by ring 74 as before. It is important to note, however, that once the second ring 56 is in place, it cooperates with the corresponding ring on end link 52M to limit the tilt of the latter to the phantom line position which narrows the gap in the throat of link 52 to a degree where the ball segments 82 can no longer be removed nor can they escape. The last of the three link assemblies 50 follows the same sequence as the first two as does completing the connection between the latter and plug 34. Ring 56 on the socketed link 52 nearest the cylinder 16 engages the adjacent end 32 thereof in the same manner that any two adjacent rings coact to prevent sufficient tiltable movement therebetween to permit removal of the ring segments 82. Once assembled, the mandrel cannot be disassembled without first removing the plug from cylinder 16. In both assembly and disassembly, indentation 94 is helpful in getting the segments 82 in and out of socket 76 as well as moving them around the neck.

In closing, it is, perhaps, worthwhile to note the hollowed-out underside 110 of each ring that surrounds the tapered base and cooperates therewith to define an annular cavity for the reception of the rim 112 of the adjacent ring therebeneath when in the tilted or bent relation shown in FIG. 1. This same cavity accepts the edge 114 of the stepped cylinder in recessed relation as shown.

What is claimed is:

1. The improved ball and socket assemblies connectable in end to end relation with rings therearound to define the bendable portion of a pipe bending mandrel which comprise: at least two elongate rigid links contoured to provide a spherically-shaped head of less than 180° in angular extent at one end, a body at the end opposite said head•having an outer surface shaped to receive and detachably mount a ring, and a neck of reduced size interconnecting said head and body, the body of at least one of said links having a spherical socket therein of the same curvature as said head but of greater than 180° in angular extent and having a mouth opening in a direction opposite the latter; and, at least two arcuate spherically-surfaced ring segments adapted to encircle the neck adjacent the head of another of said link members, said segments cooperating with one another and said adjacent head to define a ball sized mate with the socket in said one socket-carrying link to form a universal coupling therewith.

2. The improved ball and socket assembly of claim 1 wherein the mouth of each socket in the socket-carrying links is so dimensioned relative to the size of the neck of the adjacent link housed therein that the maximum gap creatable therebetween in all but selectable positions thereof is too narrow to permit insertion or removal of the ring segments; and, wherein the body of each socket-carrying link is recessed adjacent the mouth thereof to receive a portion of the adjacent link in at least one selected position so as to produce a gap diametrically opposite said recess of a size sufficient to permit removal on insertion of said ring segments.

3. The improved ball and socket assemblies of claim 1 wherein the head and ring segments cooperate in assembled relation to define a ball-encircling groove therebetween; the socket of each socket-carrying link has a shallow groove aligned with said ball-encircling groove when the links of said ball and socket coupling are axially aligned; and a spring ring is mounted in said ball-encircling groove normally biased out against the socket, said ring and grooves cooperating in coplanar relation to releasably retain the links in axial alignment.

4. The improved ball and socket assemblies of claim 1 wherein a retaining ring groove encircles the neck of each link between the ring segments and body; and wherein a retaining ring seats within said retaining ring groove effective to prevent removal of said ring segments.

5. The improved ball and socket assemblies of claim 1 wherein the socket is between approximately 240° and 250° in angular extent.

6. The improved ball and socket assemblies of claim 1 wherein three ring segments encircle each neck, each of said ring segments being approximately 120° in arcuate extent.

7. The improved ball and socket assemblies of claim 1 wherein the neck comprises a surface of revolution; and, in which the axes of the socket, head and ring-carrying surface of the body lie in coaxial relation to said surface of revolution.

8. The improved ball and socket assembly of claim 1 wherein at least one of the ring segments includes a tool-receiving recess in the spherical surface thereof accessible from outside the socket having the latter.

9. The improved ball and socket assembly of claim 2 wherein a ring member encircles the body of each link member; and, wherein adjacent ring members cooperate with one another to define interengaged stops effective to prevent said portion of said adjacent link from entering said recess in any position thereof.

10. The improved ball and socket assembly of claim 3 wherein the neck comprises a surface of revolution; and, in which the common plane of said grooves and spring when the links are axially aligned lies perpendicular to the axis of said surface of revolution.

* * * * *